US010112104B2

(12) United States Patent
Laug et al.

(10) Patent No.: US 10,112,104 B2
(45) Date of Patent: Oct. 30, 2018

(54) SNOWSHOE WITH MULTI-DENSITY FOAM DECK

(71) Applicant: CRESCENT MOON SNOWSHOES, INC., Boulder, CO (US)

(72) Inventors: Tamara Laug, Boulder, CO (US); Jake Thamm, Boulder, CO (US); Dan Laska, Lyons, CO (US)

(73) Assignee: Cresent Moon Snowshoes, Inc., Boulder, CO (US)

( * ) Notice: Subject to any disclaimer, the term of this patent is extended or adjusted under 35 U.S.C. 154(b) by 102 days.

(21) Appl. No.: 15/296,988

(22) Filed: Oct. 18, 2016

(65) Prior Publication Data

US 2018/0043235 A1 Feb. 15, 2018

Related U.S. Application Data

(63) Continuation-in-part of application No. 29/558,177, filed on Mar. 15, 2016.

(51) Int. Cl.
*A63C 13/00* (2006.01)

(52) U.S. Cl.
CPC ..... *A63C 13/005* (2013.01); *A63C 13/001* (2013.01); *A63C 13/003* (2013.01)

(58) Field of Classification Search
CPC ..... A63C 13/00; A63C 13/001; A63C 13/003; A63C 13/005
USPC ..... 36/122, 124
See application file for complete search history.

(56) References Cited

U.S. PATENT DOCUMENTS

| | | | | |
|---|---|---|---|---|
| 3,269,037 | A * | 8/1966 | Massicotte | A63C 13/001 280/11.14 |
| 3,600,829 | A * | 8/1971 | Violette | A63C 13/001 36/124 |
| 4,720,927 | A | 1/1988 | Abegg | |
| 5,025,573 | A | 6/1991 | Giese et al. | |
| 5,675,915 | A | 10/1997 | Faughn et al. | |

(Continued)

FOREIGN PATENT DOCUMENTS

| | | |
|---|---|---|
| JP | 08173203 | 7/1996 |
| WO | 2008000979 | 1/2008 |
| WO | 2012093191 | 7/2012 |

OTHER PUBLICATIONS

International Search Report and Written Opinion, for Application No. PCT/US2017/053886, dated Jan. 16, 2018.

*Primary Examiner* — Marie Bays
(74) *Attorney, Agent, or Firm* — Marsh Fischmann & Breyfogle LLP; Kent A. Fischmann

(57) ABSTRACT

A snowshoe (1500) is formed from multi-density foam materials. The snowshoe (1500) generally includes a deck 1502 and binding 1504 mounted on the deck 1502. The deck 1502 is formed from layers of flexible multi-density foam materials and has a continuously curved bottom surface to promote forward rocking motion. Consequently, it is not necessary to provide a pivot plate with crampons or to provide an opening in the deck 1502. The deck 1502 further includes a traction plate 1510. The traction plate 1510 is formed from a material that is harder than the lower layer of the deck 1502. The traction plate 1510 includes a number of cleats 1512 distributed from side-to-side and front-to-back across the traction plate 1510. Each of the cleats 1512 includes a number of spikes 1514 for penetrating snow or ice to provide enhanced traction.

16 Claims, 17 Drawing Sheets

(56) References Cited

U.S. PATENT DOCUMENTS

| | | | | |
|---|---|---|---|---|
| 5,720,120 | A | 2/1998 | Smith | |
| 5,881,477 | A * | 3/1999 | Watson | A63C 13/001 36/122 |
| 6,052,922 | A * | 4/2000 | Bleck | A43B 5/0419 36/124 |
| 6,163,984 | A | 12/2000 | Faber et al. | |
| 6,178,666 | B1 * | 1/2001 | Kiniry | A63C 13/001 36/124 |
| 6,195,919 | B1 * | 3/2001 | Forrest | A63C 13/005 36/116 |
| 6,421,935 | B1 | 7/2002 | Bartlett | |
| 6,516,539 | B2 | 2/2003 | Nishiwaki et al. | |
| 8,171,658 | B2 * | 5/2012 | Samuels | A63C 13/006 36/122 |
| 9,107,469 | B2 | 8/2015 | Brunsvig et al. | |
| 2002/0017771 | A1 * | 2/2002 | McManus | A63C 5/02 280/600 |
| 2003/0101622 | A1 * | 6/2003 | Darnell | A43C 15/06 36/122 |
| 2009/0265957 | A1 * | 10/2009 | Laug | A63C 13/001 36/125 |
| 2011/0314699 | A1 | 12/2011 | Byrne | |
| 2012/0216424 | A1 | 8/2012 | Lyden | |
| 2014/0123521 | A1 * | 5/2014 | Johnston | A63C 13/003 36/124 |
| 2014/0237852 | A1 | 8/2014 | Oberschneider et al. | |
| 2015/0202524 | A1 * | 7/2015 | Viniero | A63C 13/003 36/124 |
| 2015/0202525 | A1 * | 7/2015 | Viniero | A63C 13/003 36/124 |
| 2016/0051887 | A1 | 2/2016 | Gallay | |

* cited by examiner

SNOWSHOE WITH MULTI-DENSITY FOAM DECK

BACKGROUND OF THE INVENTION

1. Field of the Invention

The present invention relates in general to snowshoes and, in particular, to a snowshoe with a flotation platform or deck made at least in part from multi-density foam materials. The snowshoe also has a fixed-heel design, free from any hinged mounting platform, in combination with a rocker deck thereby simplifying use and promoting a natural gait.

2. Description of Related Art

Snowshoes have traditionally been used as a convenient means to traverse relatively deep snow. It is believed that snowshoes have been used by Native American people for more than 1,000 years to move in snow and on ice. Snowshoes typically include a floatation deck and bindings for attaching the deck to footwear of the user. The deck was traditionally formed from a rigid perimeter structure supporting flexible decking. Originally, rawhide straps were used for the decking of the snowshoes with the bindings formed by a number of loose straps. The rawhide straps were wrapped about a wooden perimeter structure formed from bent branches.

With the increased interest in outdoor activities, the use of snowshoes or trails and in the backcountry has grown significantly. Modern snowshoes still generally include a deck for providing flotation in snow and a binding for engaging footwear of the user. The deck is typically formed by decking of strong, flexible material attached to a perimeter structure or frame formed from lightweight structural material such as aluminum tubing. Some snowshoes have used a rigid plastic deck. The binding may be mounted on a pivot plate that pivots through an opening in the decking. While this design has generally proved to be effective, the materials and construction costs are not insignificant.

The rigid perimeter structure is designed to support the decking and, in turn, the weight of the snowshoer. Moreover, the perimeter structure resists deflection under pressure such that snow is compressed under the decking to provide floatation in loose or deep snow. It will be appreciated that the compressed snow applies pressure at points across the decking such that the pressure integrated across the surface area of the decking eventually provides a floatation force sufficient to float the snowshoer.

A snowshoer may use a stepping or shuffling motion to move forward on snowshoes. In either case, each step generally begins by planting the back end of the forward snowshoe, then transferring a large portion of the weight of the snowshoer over the center portion of the forward snowshoe, and finally pushing-off by applying pressure to the snow or ice surface from the front end of the snowshoe or a crampon. In this regard, the binding is generally attached to a rigid pivot plate connected to the perimeter structure by a hinge so that the plate can rotate downwardly through an opening in the decking as the user pushes-off. The plate may then rotate back, or return pivot, to a parallel relationship with the deck as the snowshoe is moved forward or planted for the next step. A crampon is generally provided at the front end of the plate to provide enhanced friction for the push-off. Moreover, the return pivot, and sensation that the support surface is independent of the user's foot, can be difficult for new user's to master.

It will thus be appreciated that the deck is relatively fixed in place during a large portion of the stepping motion as the plate rotates relative to the deck. The perimeter structure may be inclined near the front and rear ends to accommodate the stepping motion, but is generally substantially planar between these end portions. Consequently, any rolling sensation associated with the stepping motion, especially on hard-packed snow or ice, is largely a function of pivoting of the traction plate rather than rocking of the deck. This is an unnatural effect for many users as the human foot is designed to roll during stepping motion so as to gradually transfer weight from heel-to-toe. Moreover, the rigid perimeter structure is unforgiving, particularly on hard-packed snow or ice, and can be uncomfortable for the user and lead to early fatigue.

DESCRIPTION

Figure 1:
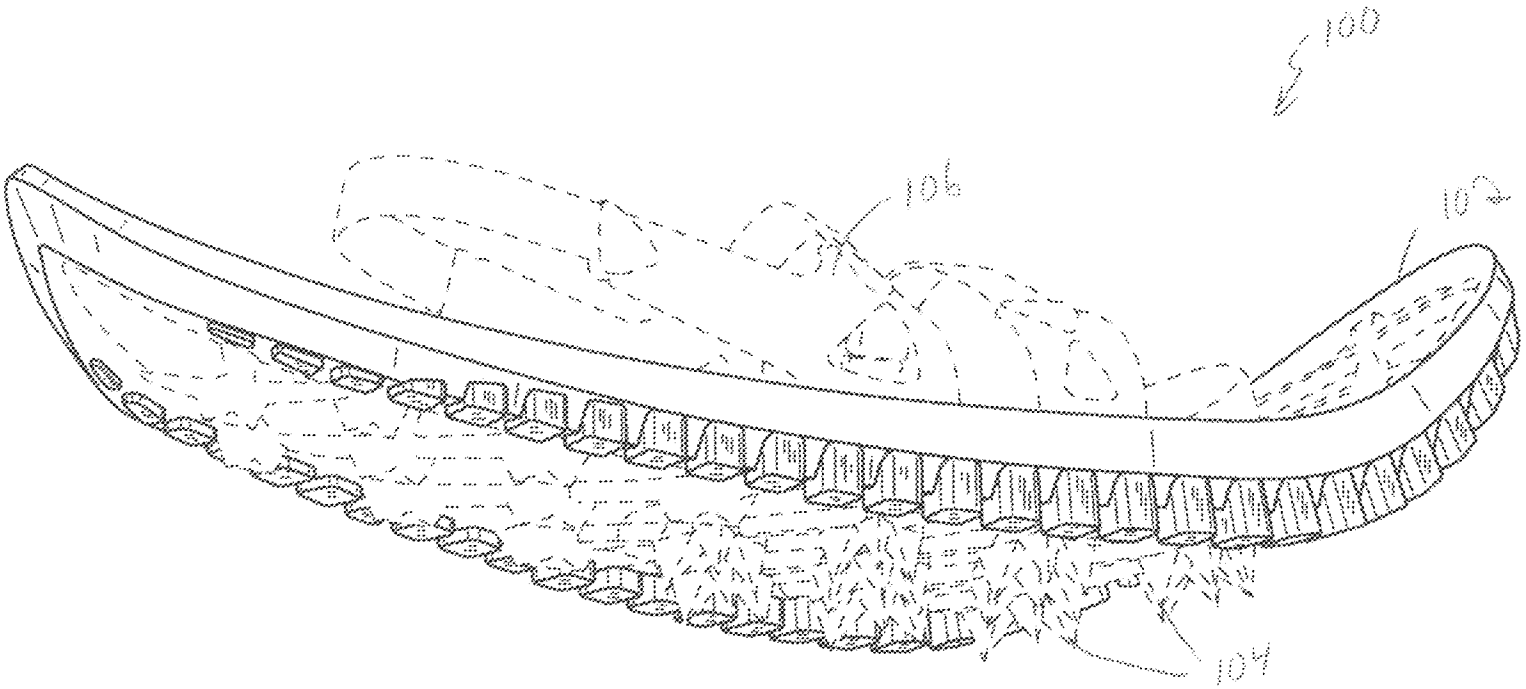
FIG. 1 is a perspective view of a snowshoe according to one embodiment of the invention.
Figure 2:
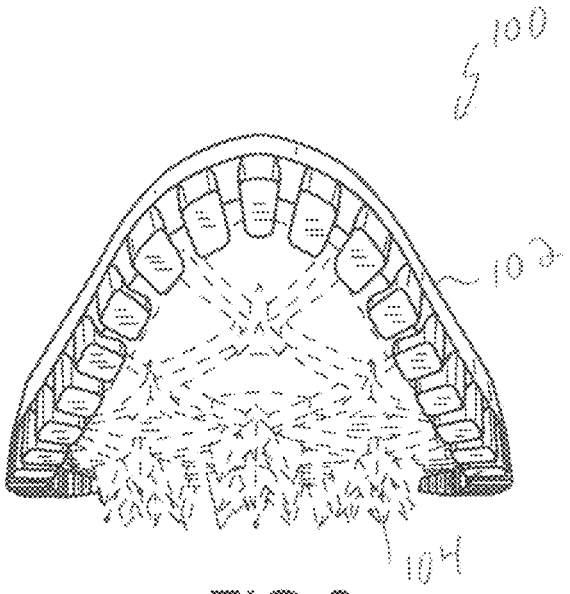
FIG. 2 is a front view of the snowshoe of FIG. 1.
Figure 3:
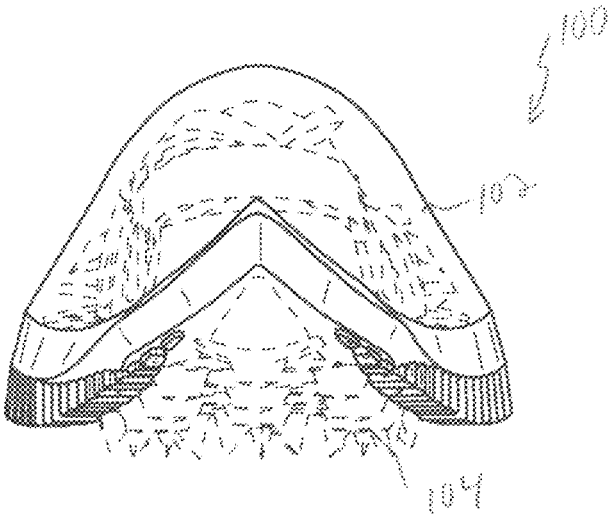
FIG. 3 is a rear view of the snowshoe of FIG. 1.
Figure 4:
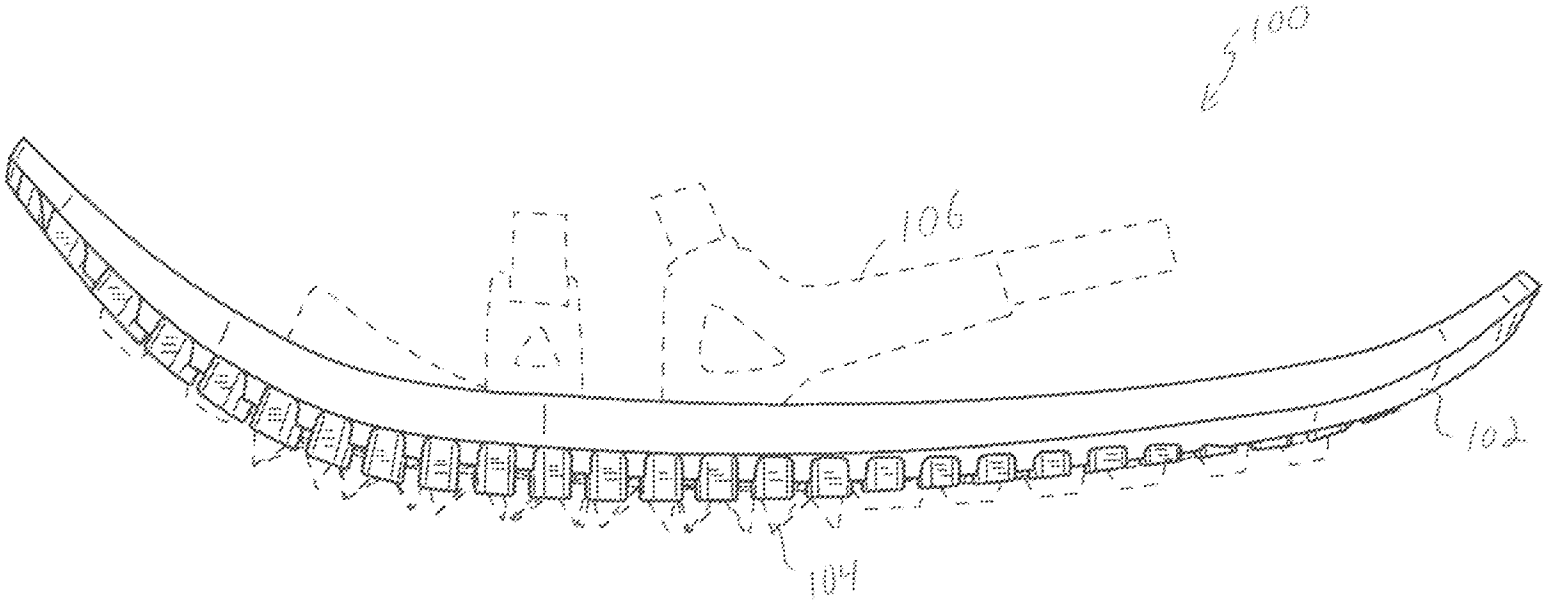
FIG. 4 is a left sider view of the snowshoe of FIG. 1.
Figure 5:
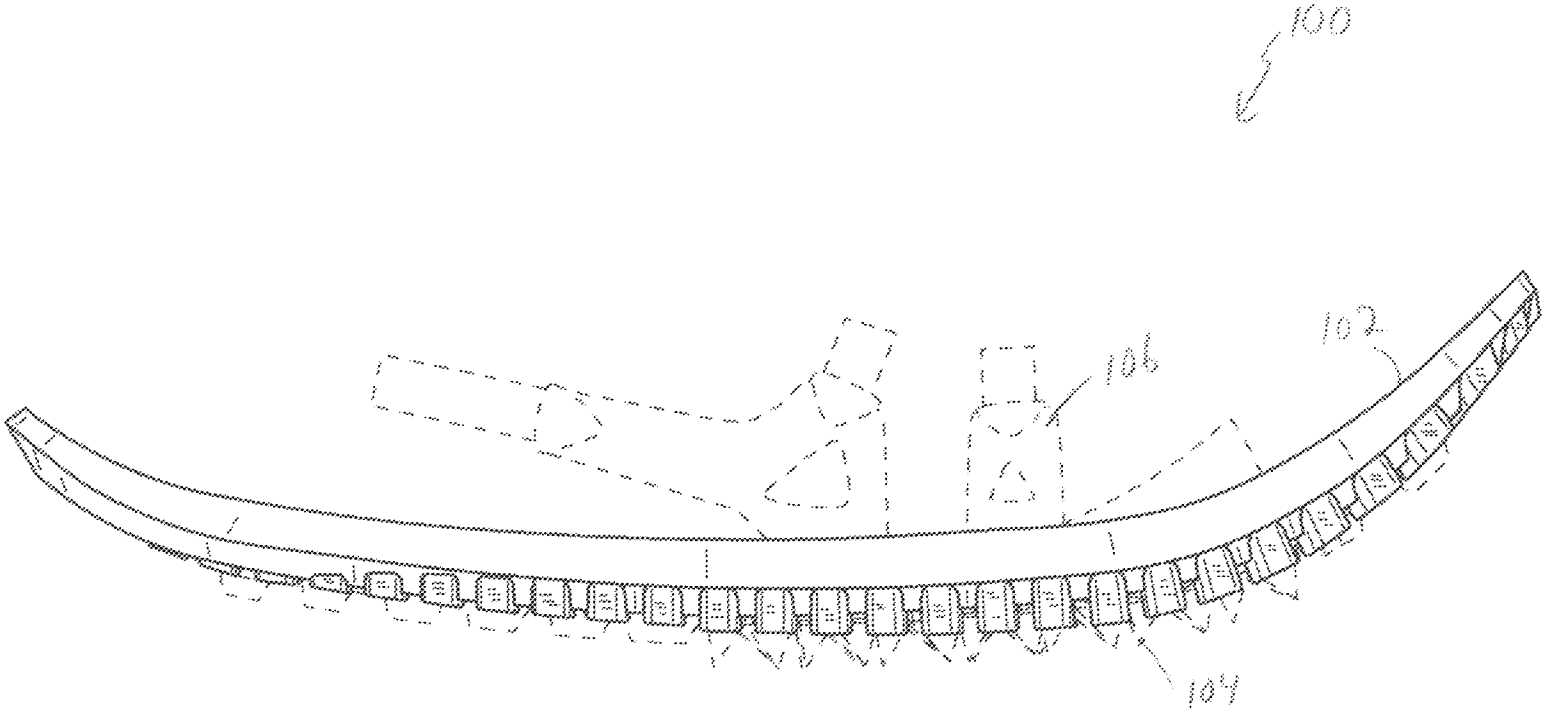
FIG. 5 is a right side view of the snowshoe of FIG. 1.
Figure 6:
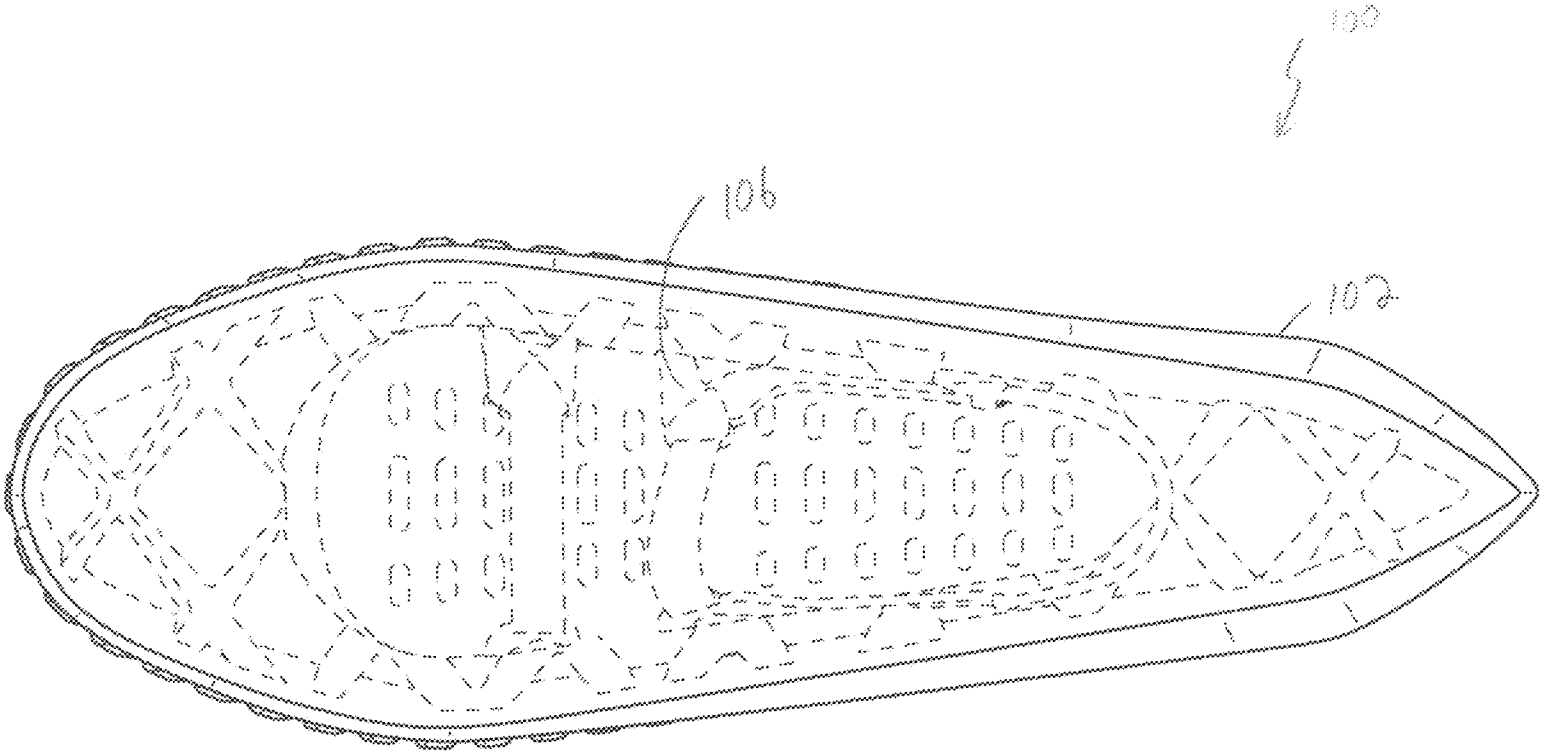
FIG. 6 is a top view of the snowshoe of FIG. 1.
Figure 7:
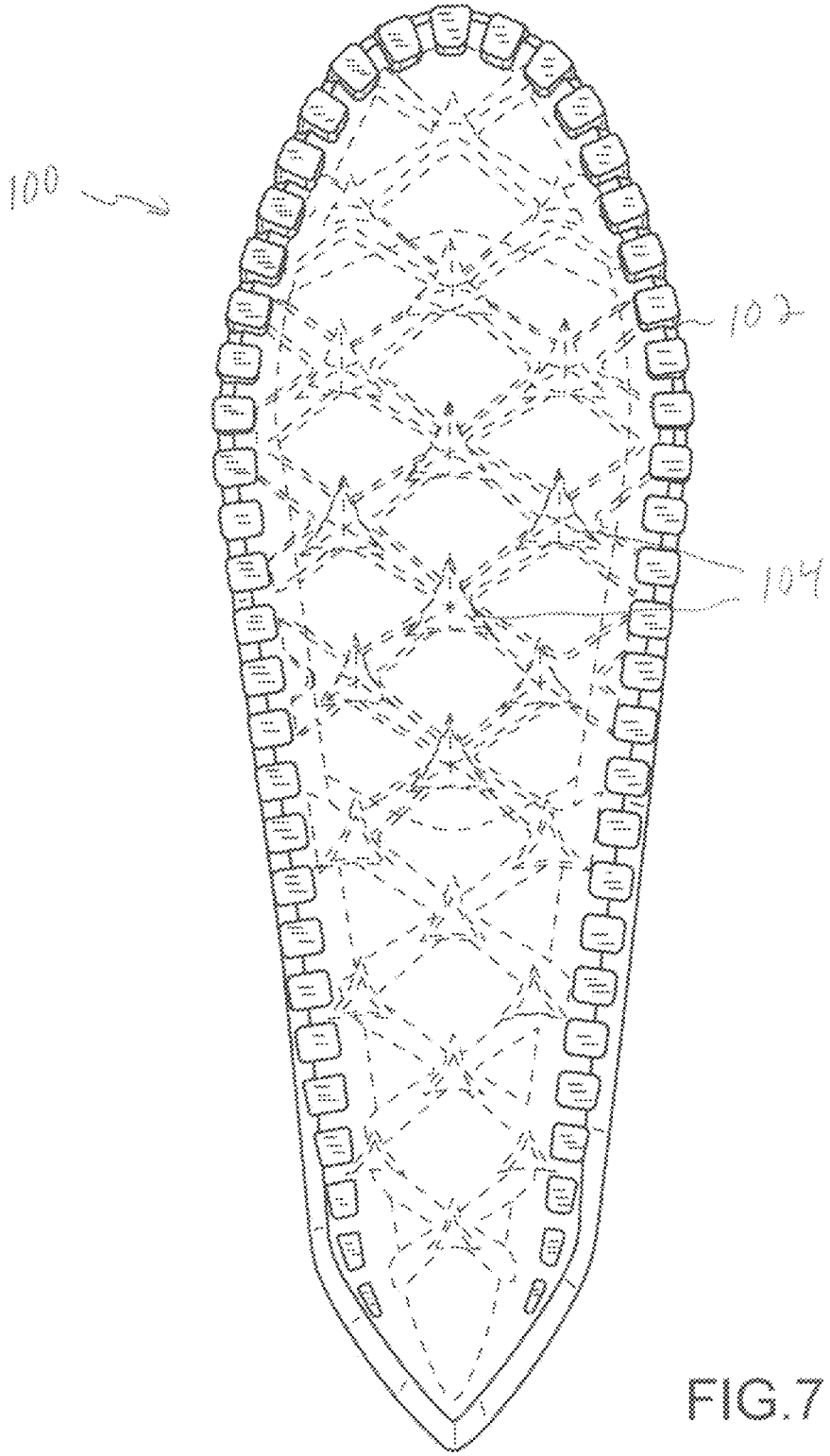
FIG. 7 is a bottom view of the snowshoe of FIG. 1.
Figure 8:
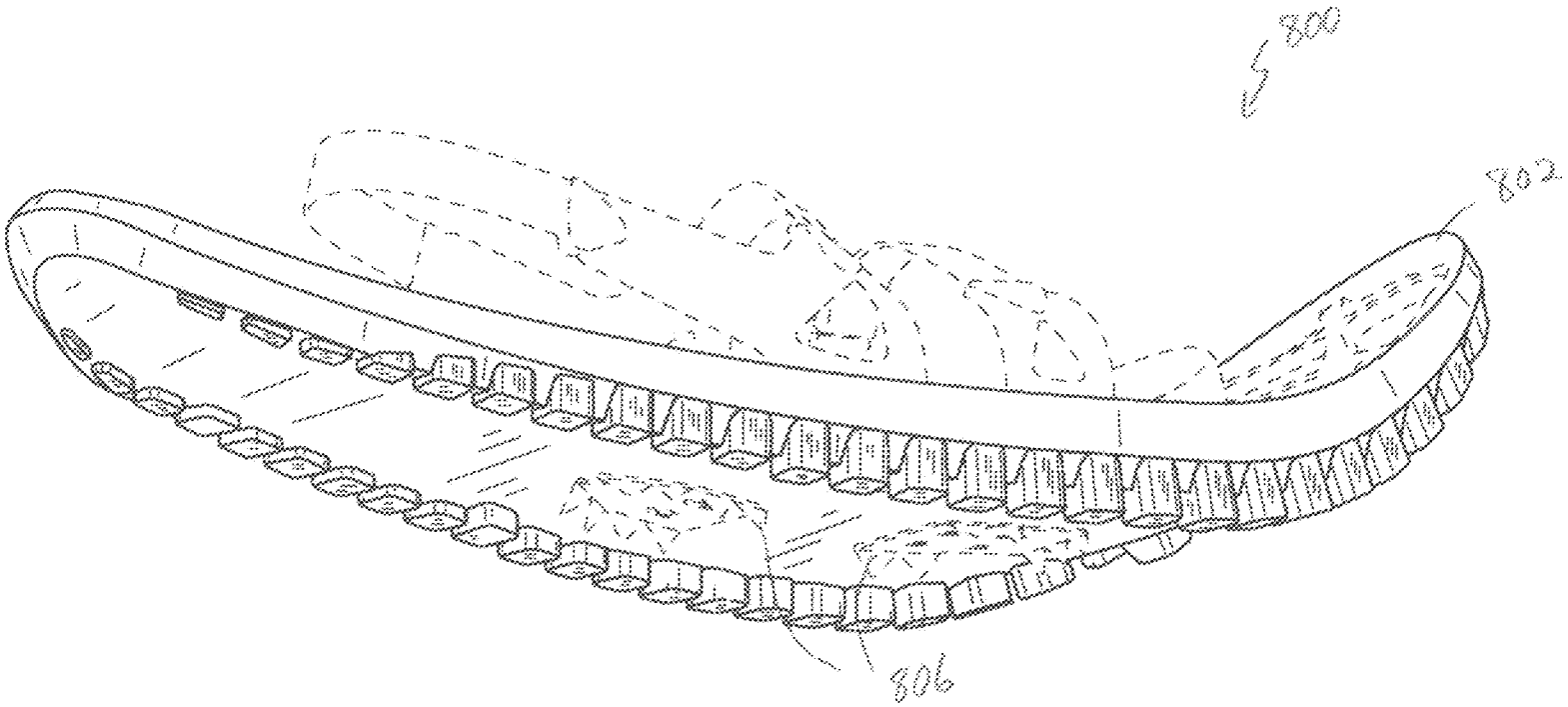
FIG. 8 is a perspective view of a snowshoe according to another embodiment of the invention.
Figure 9:
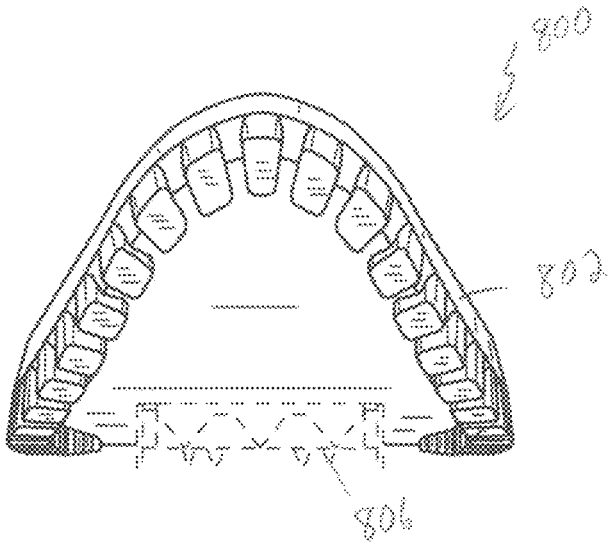
FIG. 9 is front of the snowshoe of FIG. 8.
Figure 10:
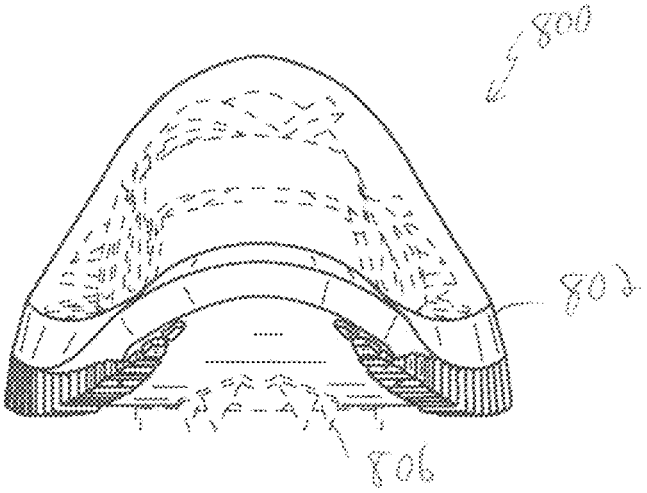
FIG. 10 is a rear view of the snowshoe of FIG. 8.
Figure 11:
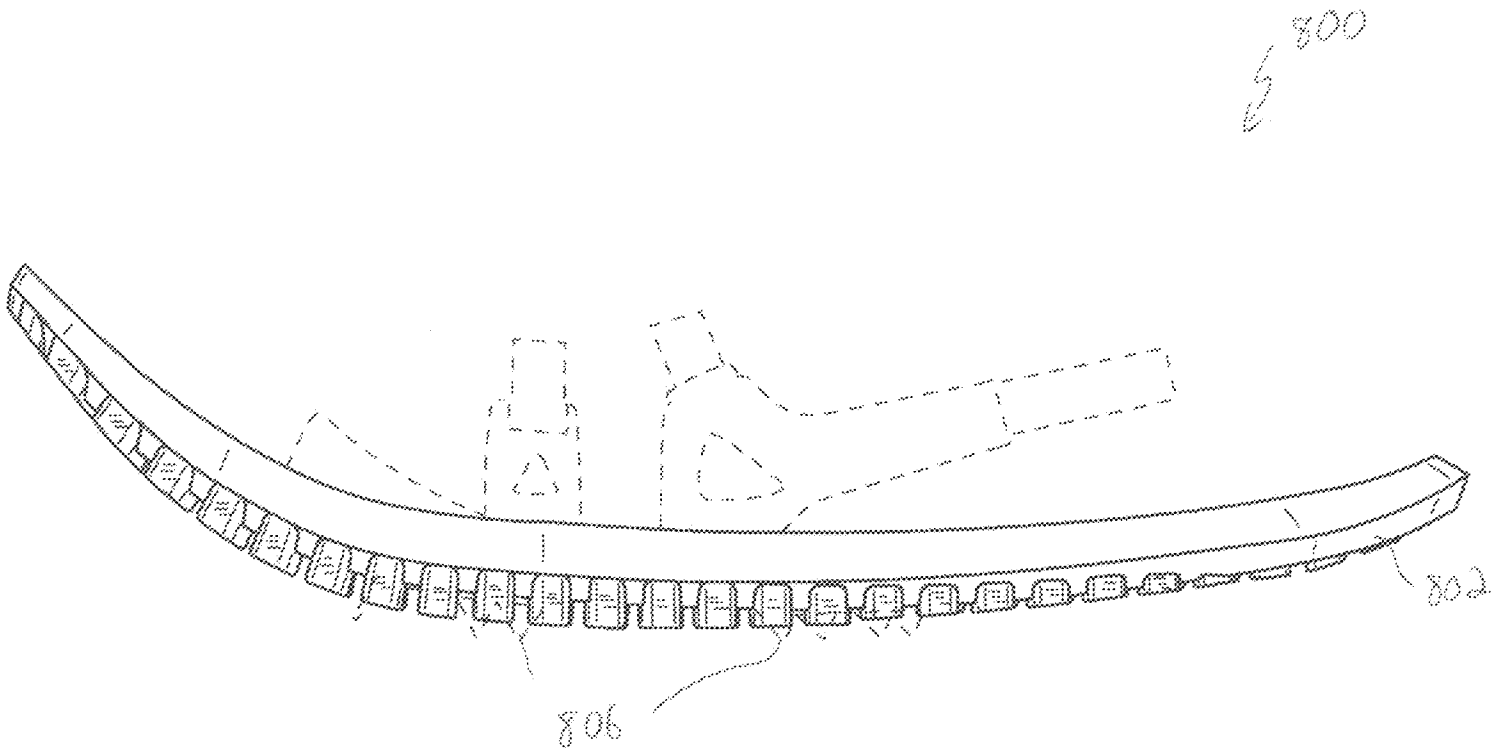
FIG. 11 is a left side view of the snowshoe of FIG. 8.
Figure 12:
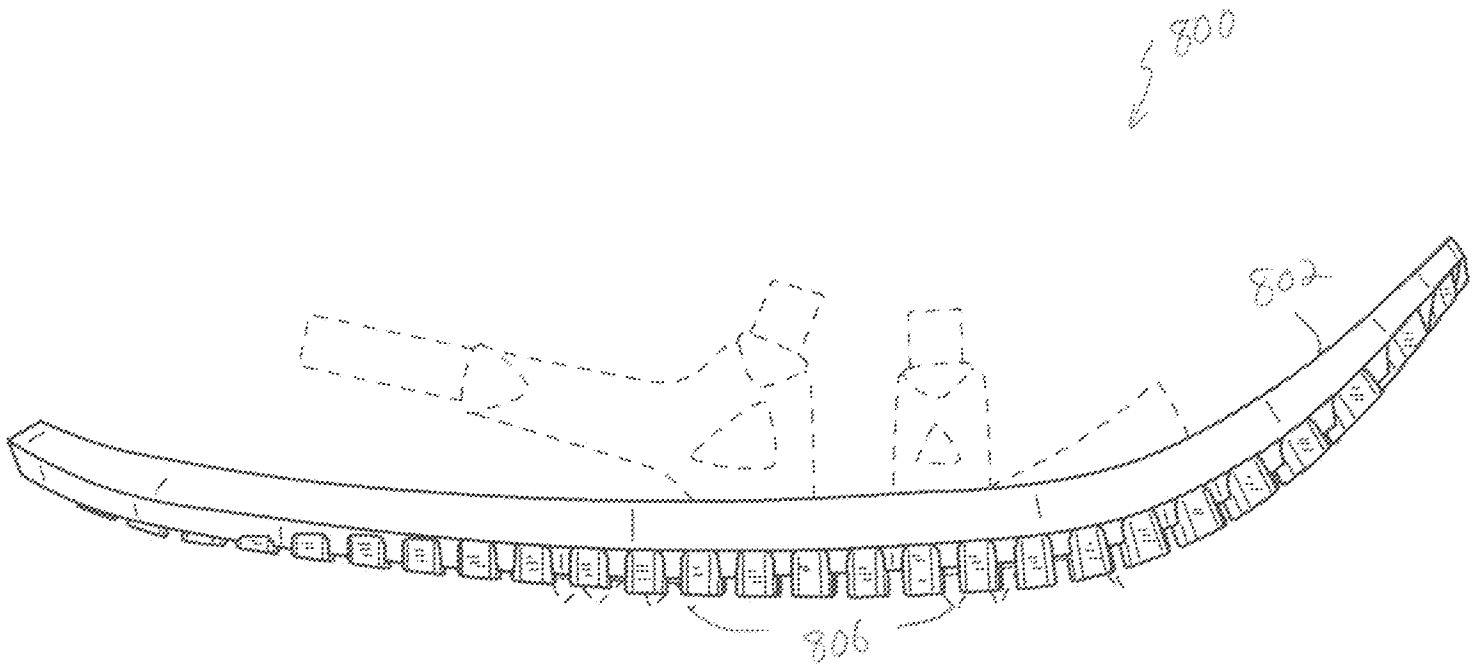
FIG. 12 is a right side view of the snowshoe of FIG. 8.
Figure 13:
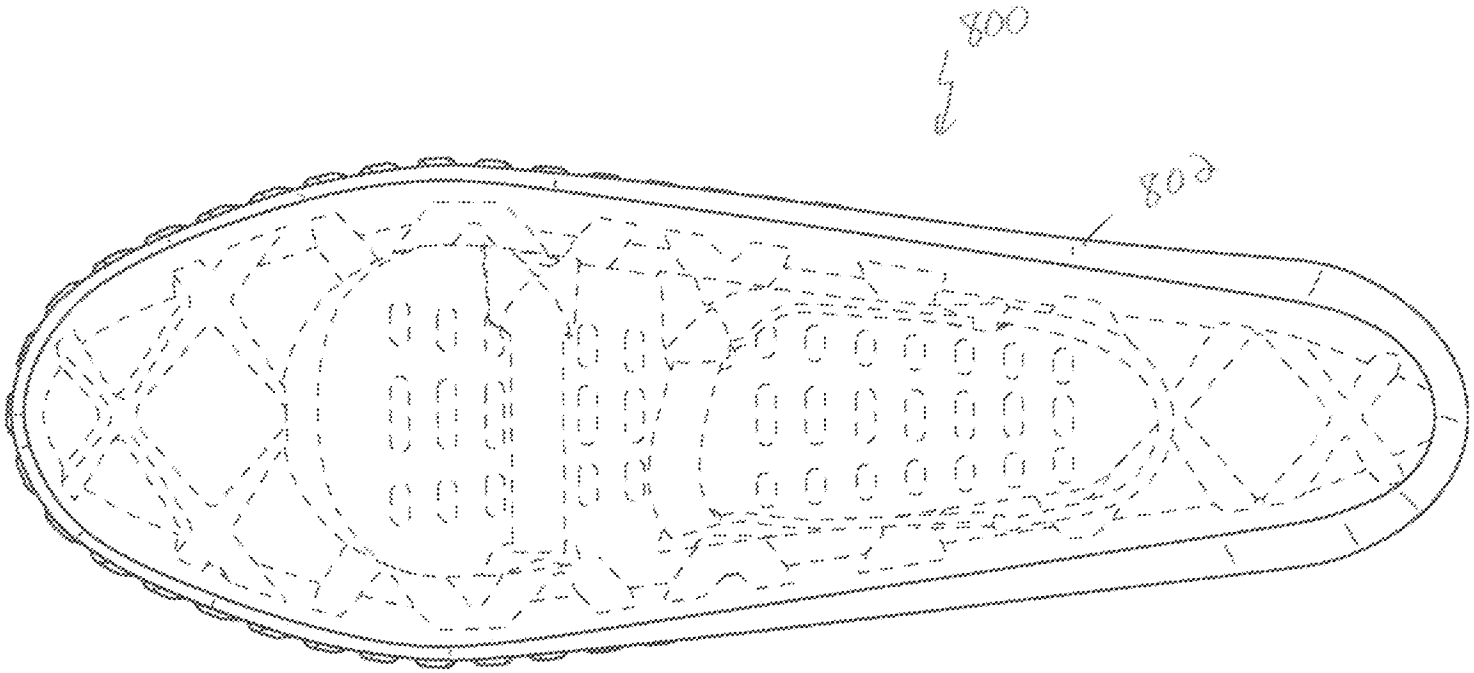
FIG. 13 is a top view of the snowshoe of FIG. 8.
Figure 14:
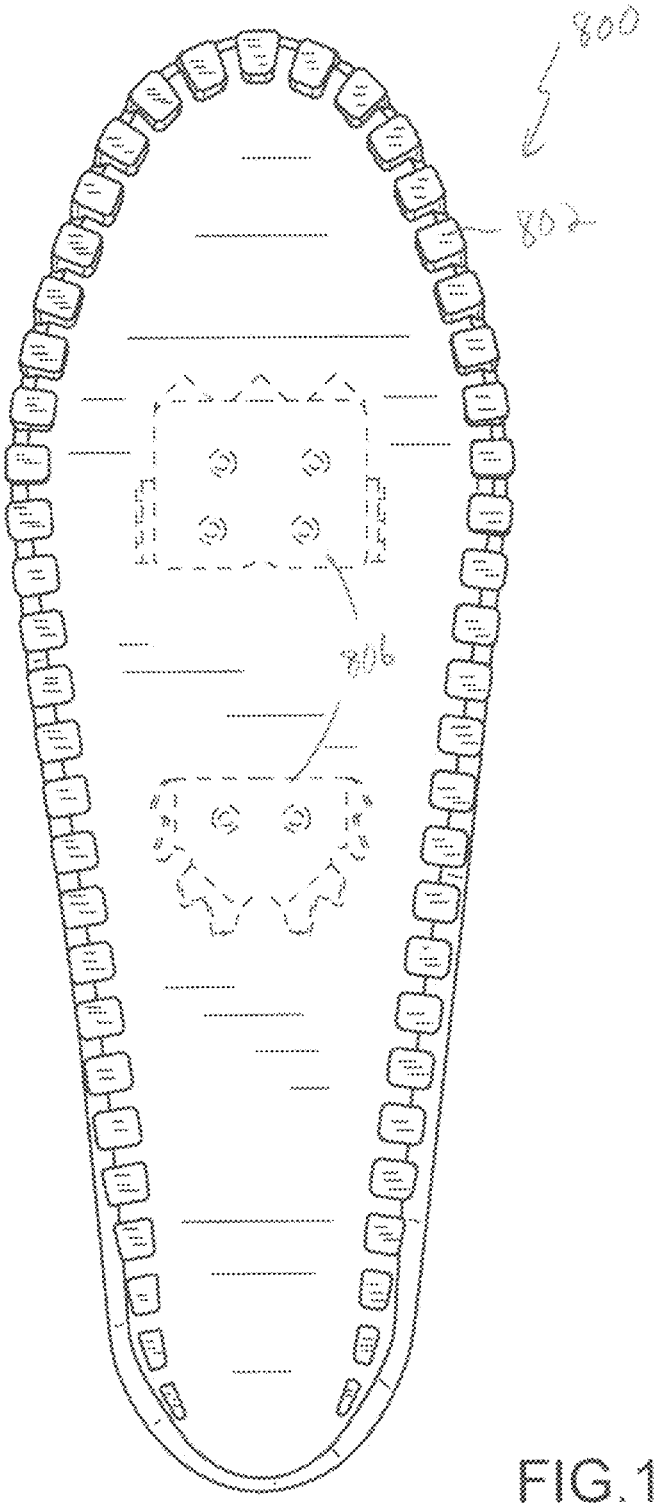
FIG. 14 is a bottom view of the snowshoe of FIG. 8.
Figure 15:
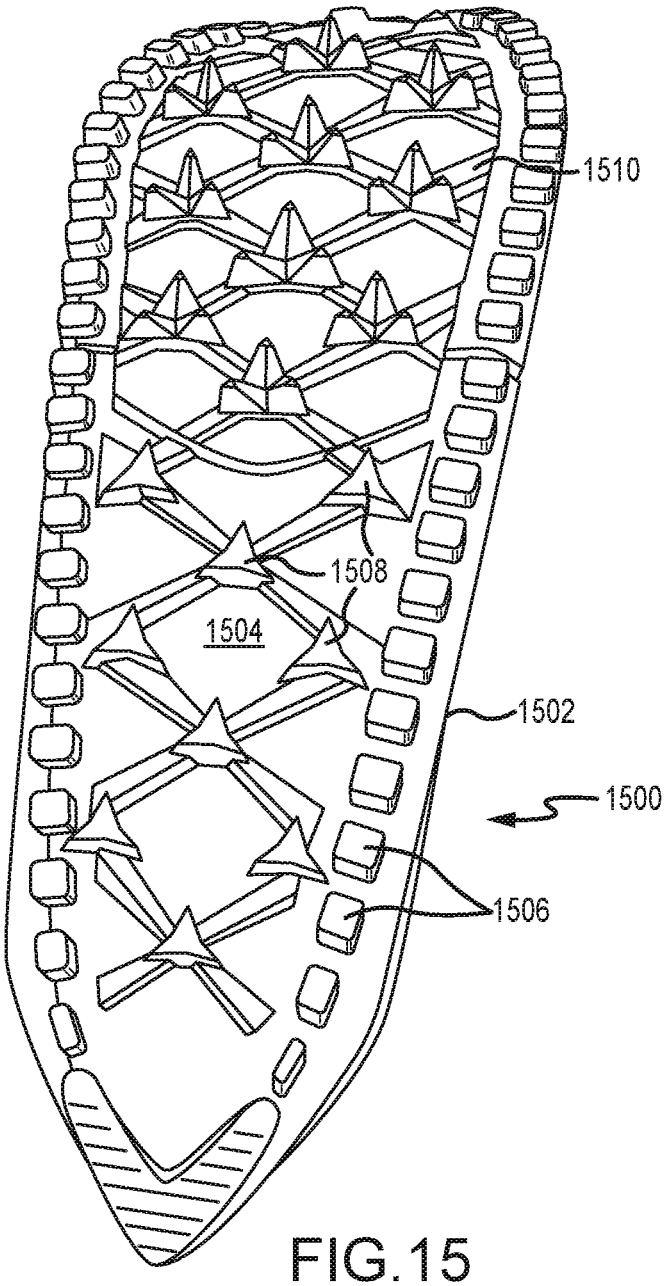
FIG. 15 is a bottom, perspective view of a snowshoe according to a further embodiment of the invention.
Figure 16:
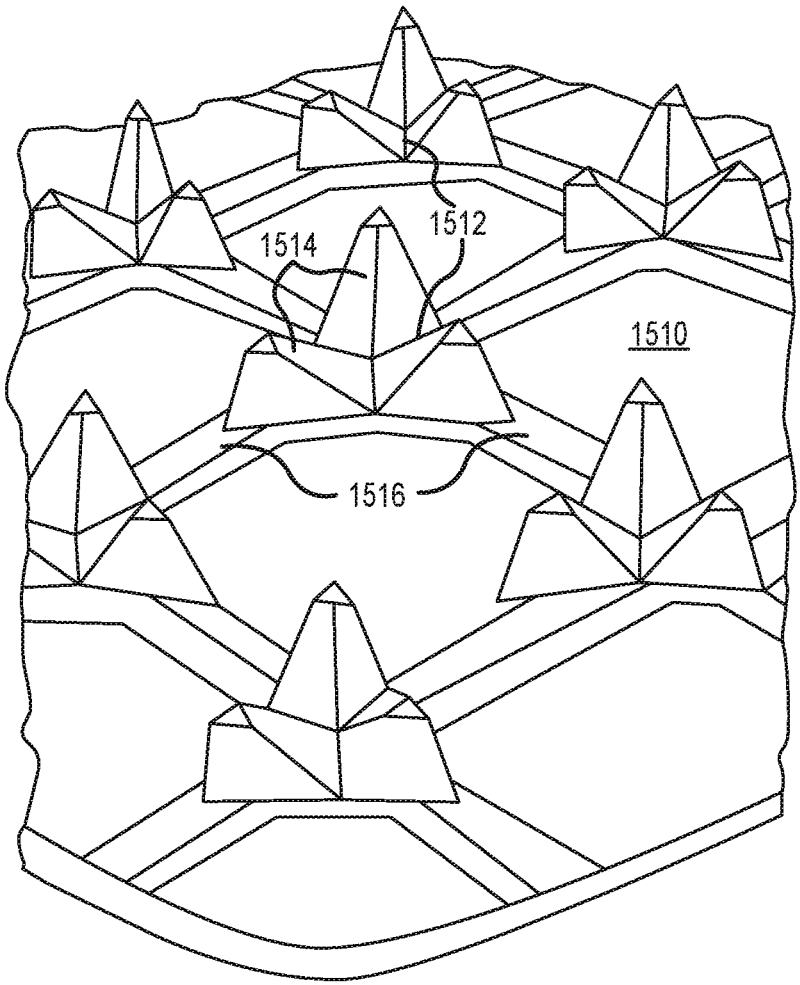
FIG. 16 is an enlarged, perspective view of a portion of the snowshoe of FIG. 15 showing the traction spikes.

The present invention is directed to a snowshoe having a deck formed from multi-density foam materials. The deck can flex to support a comfortable stepping motion and avoid the need for a pivot plate or opening in the deck. In addition, the deck is shaped or otherwise designed to promote forward, rocking motion in connection with stepping or shuffling movement. The snowshoe also includes traction features to resist slipping slopes (e.g., side slopes, uphill slopes, downhill slopes) and improve push-off traction. The snowshoe is of simple inexpensive construction, is lightweight and comfortable in use, provides improved floatation, and promotes natural-feeling forward rocking motion.

In accordance with one aspect of the present invention, a snowshoe with a multi-density foam deck is provided. The snowshoe includes a deck for providing floatation in snow, and a binding for attaching the deck to a user's footwear, wherein the deck has a multi-density material construction including a first layer having a first density and a second layer having a second density different than the first density.

It should be noted that different densities are associated with a number of related mechanical or material properties. For example, while hardness and density are not always correlated, for a given foam material (e.g., EVA), hardness generally increases with density. Accordingly, it is common, even if not technically correct, for manufacturers to specify "density" in units of hardness. Similarly, for a given foam material, stiffness (i.e., resistance to flexing under pressure), strength and toughness (i.e., resistance to penetration) are closely correlated to density. Accordingly, the discussion below primarily refers to density in describing a deck that accommodates a number of competing concerns relating to deck flexion/stiffness, softness, strength, stability, and toughness.

With regard to softness, it is desirable that the upper deck surface is soft, at least underfoot, so as to provide some cushioning and rebound. This is particularly important as preferred designs include a fixed-heel binding such that forces associated with the deck striking ice or snow are translated to the user's footwear. Shock absorption may be enhanced not only by cushioning due to upper layer softness, but also acceleration damping associated with deck flexion, at least in the tail section of the deck.

Deck flexion is important for additional reasons. Some flexion not only reduces shock, but also provides forgiveness when the foot is planted unevenly or on irregular surfaces. Moreover, some flexion, in combination with or as an alternative to bottom surface shaping, can promote forward rocking motion as desired, particularly for fixed-heel bindings where foot motion is restricted. On the other hand, too much flexion can unduly impair the effectiveness of the deck in providing floatation. The amount of flexion and location of flex can be controlled by shaping the deck to include thicker areas (e.g., ridges), thinner area or the like.

Somewhat related to flexion is strength. As noted above, floatation requires that snow is compacted under the deck and the deck should therefore be capable of withstanding the pressure associated with snow compaction across the full area of the deck. Similarly, on ice or other surfaces that don't give, substantial forces may be exerted on peripheral portions of the deck, resulting in large moments exerted on the deck materials. It is important that the composite deck materials are generally sufficiently strong to withstand such use without failure. In this regard, the deck should hold its shape without twisting or collapsing during normal use.

Stability relates to promoting a sense of sure-footedness for the user. As noted above, some flexion can avoid unsteadiness or twisted ankles. However, too much flexion may result in a feeling of unsteadiness, i.e., a feeling that the user's foot is not securely planted on the ground.

Finally, toughness is necessary to avoid damage, as much as is practical, to snowshoes used on rocks, branches, and other obstructions. In particular, it is important that the bottom surface of the deck is tough enough to withstand challenging environments.

The discussion below describes, primarily in relation to particular foams and densities, construction details that accommodate these various concerns. It will be appreciated, though, that alternate construction details may be utilized in accordance with the present invention.

Thus, in accordance with the present aspect of the invention, the deck includes at least first and second layers having different densities. One of both of the layers may be formed of a foam material e.g., a closed-cell foam such as EVA. For example, the deck may include a lower layer and an upper layer, where the lower layer has a higher density than the upper layer. For example, the lower layer may have a density of less than about 45 kg/m$^3$ and a hardness of between about 50-90 Asker C durometer, and the upper layer may have a density greater than about 45 kg/m$^3$ and a harness of between about 35-45 Asker C durometer. Optionally, the deck may be formed from more than two layers of materials. For example, an intermediate layer may be provided between the upper layer and the lower layer. The intermediate layer may have a density between the density of the upper layer and the density of the lower layer.

In this regard, it will be appreciated that the bottom layer provides stability for the user's foot and helps keep the shape of the deck for enhanced floatation. In addition, the bottom layer may be hard enough such that traction features formed in the bottom surface of the lower layer provide enhanced traction over a range of snow and ice surfaces. The top layer is sufficiently soft to provide impact resistance and cushioning. The optional intermediate layer may be selected to impart a desired strength and/or flexibility to the overall deck. In the latter regard, the deck preferably provides some flexibility to promote a natural-feeling stepping motion but is sufficiently strong to support the weight of the user and provide the desired floatation. It will be appreciated that the dimensions of the deck and the materials utilized can be varied depending on the weight of the user, the anticipated snow conditions (powder versus hard-packed snow or ice), and other factors. The deck may further include additional elements to provide the desired flexibility and strength. For example, reinforcing layers, partial reinforcing layers, ribs, other features to increase flexibility or stiffness, and the like may be utilized. It has been found that, in order to accommodate a natural stepping motion while providing suitable floatation, it is generally desirable to limit the total flexion of the deck to no more than about 20 degrees in relation to an unstressed configuration of the deck, In accordance with another aspect of the present invention, a snowshoe is provided that promotes forward rocking motion during use. The snowshoe includes a deck for providing floatation in snow and a binding for attaching the deck to a user's footwear such that the user's heel is maintained in a substantially fixed position in relation to the deck, wherein the deck is configured to promote forward rocking motion in connection with a stepping motion of the user. In one embodiment, a bottom surface of the deck has a continuously curved shape from a rear end to the front end of the deck. For example, the bottom surface may have a first nonzero curvature at a first portion adjacent at a front end of the snowshoe, a second nonzero curvature at a second portion adjacent a back end of the snowshoe, and a third nonzero curvature at a third portion between the first and second portions, wherein the third curvature is less than the first and second curvatures. In another embodiment, the deck is formed from a flexible material that can flex in conjunction with a stepping motion to promote the rocking effect. For example, the deck may have a thicker center with tapered ends to provide the desired flexibility. The deck may have a continuously curved shape and be formed from flexible material.

In accordance with a still further aspect of the present invention, a snowshoe with improved traction is provided. The snowshoe includes a deck for providing floatation in snow and a binding for attaching the deck to a user's footwear, wherein the deck includes a number of cleats on the bottom surface thereof. Each of the cleats includes at least three spikes disposed in a nonlinear configuration. Each of the spikes includes a generally conical, pyramid shaped, or ridge-like portion so as to provide a sharp surface for penetrating hard-packed snow or ice. In one embodiment, each spike has a multi-faceted pyramid-like shape. The nonlinear arrangement of spikes provides enhanced traction on side slopes, uphill slopes, downhill slopes, and pushing off. In certain embodiments the cleats are mounted on the bottom surface of a flexible deck and sequentially engage the snow or ice during rolling, stepping motion of the snowshoe. The snowshoe may further include a number of lugs distributed about a periphery of the deck for improved traction.

These various aspects of the invention, as well as additional aspects and advantages associated therewith will now be described in connection with certain illustrative embodiments of the invention. While particular embodiments will be described in order to illustrate the invention, it will be understood that many other embodiments are possible in accordance with the present invention.

In this regard, FIGS. 1-7 show various views of a first embodiment of a snowshoe in accordance with the present invention, FIGS. 8-14 illustrate another embodiment of the invention, and FIGS. 15-18K show a still further embodiment of the present invention. Each of these embodiments will be described below.

Referring first to FIGS. 15-18K, a snowshoe constructed in accordance with the present invention is generally identified by the reference numeral 1500. The snowshoe 1500 generally includes a deck 1502 and binding 1504 mounted on the deck 1502. As will be described below, the deck 1502 is formed from layers of flexible multi-density foam materials and has a continuously curved bottom surface to promote forward rocking motion. Consequently, it is not necessary to provide a pivot plate with crampons or to provide an opening in the deck 1502. The floatation of the deck 1502 is thereby enhanced.

The snowshoe 1500 is extremely easy to use and natural feeling, especially for new users. The binding 1504 is designed to be easily attached and removed from footgear, e.g., by using Velcro® straps. In addition, the binding 1504 preferably captures the whole foot of the user, i.e., does not include a free heel or hinge. Moreover, the deck 1502 is designed to promote forward rocking motion in use. Consequently, the snowshoe 1500 feels like an extension of the user's foot and allows the user to use a natural feeling gait. There is no pivoting and recoiling of the mounting plate, no need to master-timing for fluidity, and no associated slapping noises as the user's heel impacts decking when the hinge recoils.

The illustrated deck 1502 includes a bottom surface 1504 for contacting the snow or ice. As will be discussed below, the bottom surface 1504 is part of a lower layer of foam material that has a higher density than other layers of the deck 1502. The bottom surface 1504 may have a number of traction features formed therein and is thus preferably formed from a material that is sufficiently hard to provide suitable traction across a range of snow and ice surfaces. In the illustrated embodiment, the bottom surface 1504 is contoured to define a number of peripheral lugs 1506 and internal traction protrusions 1508. The peripheral lugs 1506 provide a semi-continuous peripheral structure to enhance snow compaction while allowing flexure of the deck 1502. The height of the lugs 1506 can be varied, e.g., tapering to a lower height near the back end of the snowshoe 1500. The internal traction protrusions 1508 define edges and points that resist forward, rearward, and sideways slippage.

The illustrated deck 1502 further includes a traction plate 1510. The traction plate 1510 is preferably formed from a material that is harder than the lower layer of the deck 1502. For example, the traction plate may be formed from a hard plastic such as polyether amide (PEBA) or polyurethane. For example, the plastic may have a hardness of at least 95A durometer. In the illustrated embodiment, the traction plate 1510 is received within a recess formed in the lower layer of the deck 1502. In this manner, secure mounting of the traction plate 1510 is enhanced and bottom surface of the traction plate 1510 is substantially flush with the bottom surface 1504 of the deck 1502. The illustrated traction plate 1510 is positioned to provide enhanced traction when the most force is exerted on the snowshoe 1500 during stepping motion and pushing off. That is, the traction plate 1510 is positioned under at least a portion of the ball of the foot and toes of the user. In the illustrated embodiment, the traction plate 1510 extends across nearly the full width of the snowshoe from a point adjacent an inside edge of the snowshoe to a point adjacent an outside edge of the snowshoe. Moreover, the illustrated traction plate 1510 extends across approximately one-third of the length of the snowshoe from a point adjacent the front end of the snowshoe to a point one-third to one-half the length of the snowshoe from the front end of the snowshoe. Alternatively, the traction plate 1510 may be extended further towards the back end of the snowshoe (e.g., to within 2-3 inches of the back end) to improve traction and increase the stiffness of the snowshoe. In the latter regard, longitudinal shanks could also be utilized to increase stiffness.

The traction plate 1510 preferably includes traction features to resist forward, rearward, and sideways slipping of the snowshoe 1500. In the illustrated embodiment, the traction plate 1510 includes a number of cleats 1512 distributed from side-to-side and front-to-back across the traction plate 1510. The distribution and density of spacing of the cleats 1512 may be varied and need not be consistent in relation to either a side-to-side or front-to-back axis of the traction plate 1510.

Each of the cleats 1512 includes a number of spikes 1514 for penetrating snow or ice to provide enhanced traction. In this regard, each of the spikes preferably includes sharp points or ridges to enhance penetration. Many configurations of the spikes are possible in this regard including conical-shaped, pyramid-shaped, ridge-shaped, or the like. The spikes 1514 are preferably arranged in a nonlinear configuration to provide improved traction in relation to front-to-back and side-to-side axes. In the illustrated embodiment, each of the cleats 1512 includes multi-faceted, three generally pyramid shaped spikes 1514. Each of the spikes 1514 is angled outwardly from a center of the cleat 1512. The forward most spike 1514 of each cleat 1512 in the illustrated embodiment is larger than the other spikes 1514 for enhanced traction during toe off. The illustrated traction plate 1510 further includes reinforcing ribs 1516 extending between the cleats 1512. The reinforcing ribs 1516 provide improved strength for the traction plate 1510 without unduly increasing the weight of the traction plate 1510.

Figure 17:
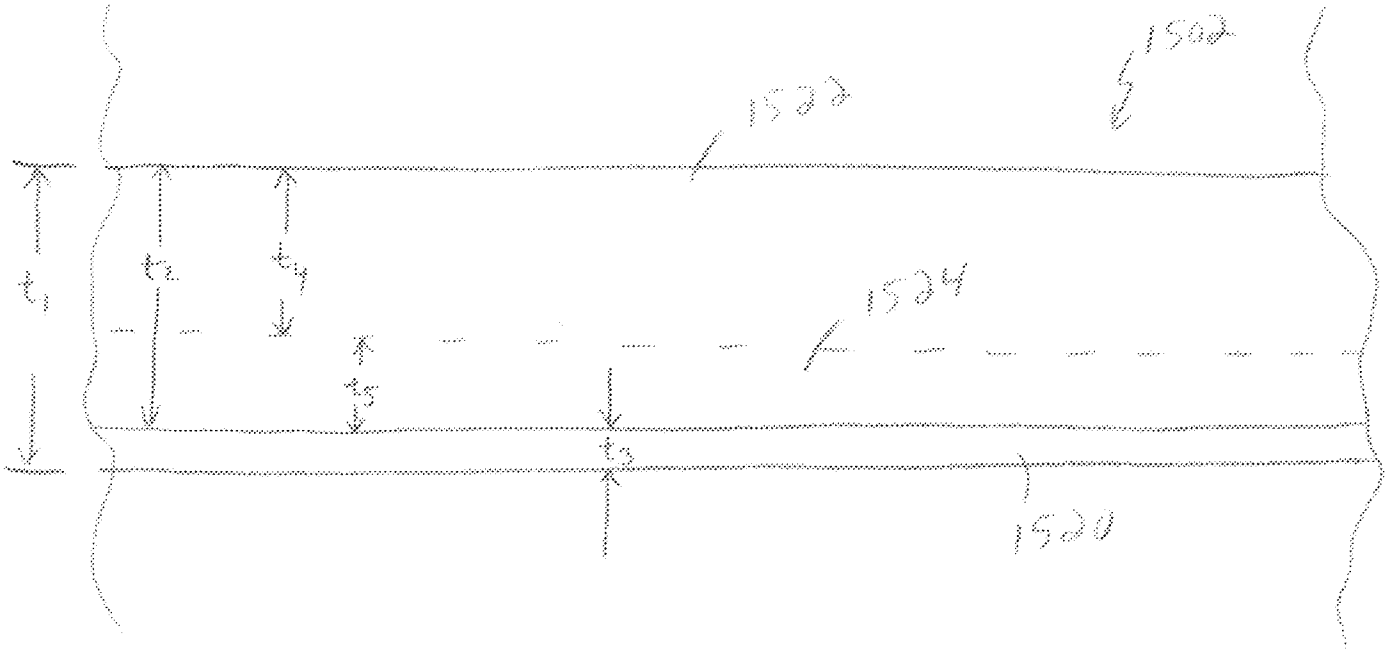
FIG. 17 is a side cross-sectional view of the snowshoe of FIG. 15 showing the layers of the decking.

FIG. 17 shows a side cross-sectional view of the snowshoe 1500. As noted above, the deck 1502 is preferably formed from multi-density foam materials. The illustrated cross-section represents the construction at a central front-to-back axis of the snowshoe 1500. It will be appreciated that the materials used and layer thicknesses used may vary relative to the front-to-back and/or side-to-side axes of the snowshoe 1500. In this regard, in preferred embodiments, the deck is thickest near the center of the snowshoe 1512 relative to the front-to-back axis and tapers towards the front end and rear end of the snowshoe 1500. For example, the thickness at a maximum point of thickness near the center of the snowshoe 1500 may be between about 30-45 mm, for example, about 38.2 mm. The thickness of the deck 1502 near the front end may be between about 15-20 mm, for example, about 18 mm. The thickness near the back end of the snowshoe 1500 may be between about 15-20 mm, for example, about 18 mm. The deck may also be thicker near the sides of the snowshoe 1500 and thinner in the center to hold its form.

Referring again to FIG. 17, the overall thickness, $t_1$, of the deck 1502 at the illustrated cross-section is about 38.2 mm. The deck includes a lower layer 1520 and upper layer 1522. The thickness, $t_3$, of the lower layer is between about 5 and 20 mm, for example, 11.5 mm. The thickness, $t_2$, of the upper layer is between about 20 and 35 mm, for example 26.7 mm. Optionally, the deck 1502 may include additional layers such as an intermediate layer 1524. Where an intermediate layer 1524 is included, the intermediate layer 1524 may have a thickness, $t_5$, between about 5 and 15 mm, for example, 10 mm and the upper layer 1522 may have a thickness, $t_4$, of between about 15 and 25 mm, for example, 20 mm. The thickness of these layers may vary from front-to-back and/or side-to-side.

The materials of the deck 1502 are selected to satisfy a number of objectives. The deck 1502 should preferably flex to some degree during use so as to promote forward rolling motion, but does not flex so much as to unduly compromise floatation. In this regard, it is preferable that the deck flex no more than about 20 degrees from an unstressed configuration. It will be appreciated that different materials and thicknesses of materials as well as different overall dimensions of the deck may be provided to accommodate different users and use cases. In addition, the lower layer is preferably formed from a material that is sufficiently hard so as to resist puncture from rocks or twigs and to allow the traction features formed in the lower layer 1520 to penetrate a range of snow and ice surfaces. The upper most surface is preferably sufficiently soft to provide cushioning for enhanced comfort and to enhance overall deck flexibility. The optional intermediate layer 1524 may be provided to achieve the desired overall flexibility, strength, stability, or other characteristics of the deck 1502.

In the illustrated embodiment, each of the lower layer 1520, upper layer 1522 and intermediate layer 1524 may formed from foam, encapsulated air, gel or other material. For example, each of the layers may be formed form Ethylene-vinyl acetate (EVA) foam, but with different densities and hardnesses. For example, the upper layer 1522 may have a density of between about 15-30 kg/m$^3$, for example, about 20 kg/m$^3$ and a hardness of between about 35-45 Asker C durometer, for example, about 40. The lower layer 1520 may have a density of between about 50-150 kg/m$^3$, for example, about 100 kg/m$^3$, and a hardness of between about 50-90 Asker C durometer, for example about 90. The intermediate layer 1524 may have a density of between about 40-75 kg/m$^3$ for example, about 50 kg/m$^3$, and a hardness of between about 45-55 Asker C durometer, for example, about 50. The deck 1502 may alternatively be formed, at least in part, from polyurethane foam which has excellent durability but is heavier than EVA foam.

Figure 18A:
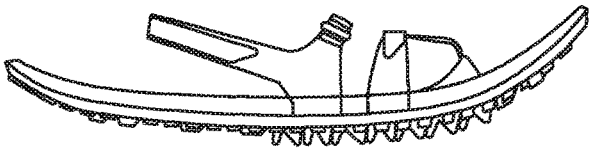
FIGS. 18A-18K show various views of the snowshoe of FIG. 15.
Figure 18B:
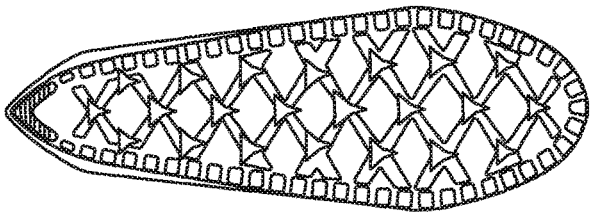
Figure 18C:
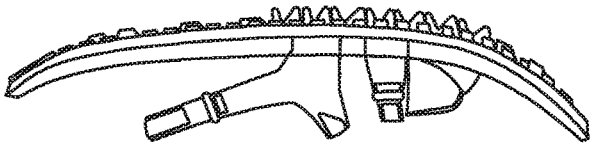
Figure 18D:
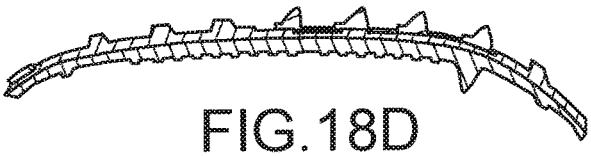
Figure 18E:
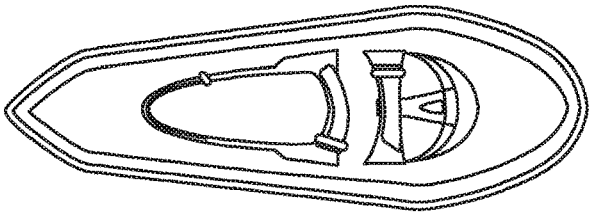
Figure 18F:
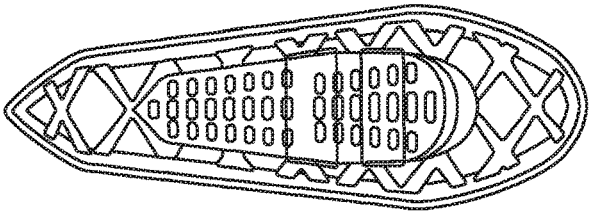
Figure 18G:
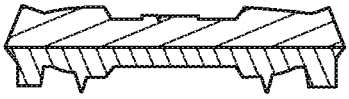
Figure 18H:
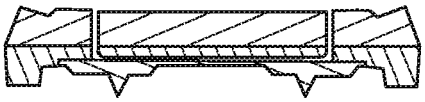
Figure 18I:
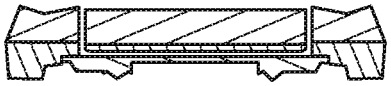
Figure 18J:
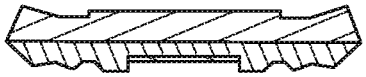
Figure 18K:
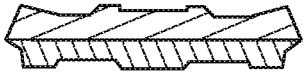

As shown, for example in FIGS. 18C-18D, the bottom surface of the snowshoe 1500 may have a continuously curved configuration relative to the front-to-back axis of the snowshoe 1500. This configuration promotes a smooth and natural rocking motion is use. The curvature preferably varies along the front-to-back axis with greater curvatures near the front and back ends of the snowshoe and a lesser curvature in-between. For example, the snowshoe may have a maximum radius of curvature in the rear section 1802 of between about 0.2-2 m, a maximum radius of curvature in the front section 1804 of between about 0.2-2 m, and a maximum radius of curvature in the middle section 1806 of between about 1-10 m. It will be appreciated that the curvature may vary within each of these sections. Alternatively, the desired rocking motion may be achieved by forming the deck 1502 with a thicker center and tapered thickness at the front and back ends to allow sufficient flexure, or by forming the deck 1502 of flexible foam and extending the more rigid traction plate 1510 to underlie a greater portion of the deck (except for portions adjacent the front and back ends).

FIGS. 1-7 show an alternative embodiment of a snowshoe 100 constructed in accordance with the present invention. The binding 106 and various traction features 104 are shown in phantom to allow the shape of the deck 102 to be more easily seen. The illustrated deck 102 may be of multilayer, multi-density foam construction as described above. The binding 106 may be mounted directly to the upper surface of the deck 102 using adhesives and/or fasteners (e.g., rivets).

Though the snowshoe 100 is similar to the snowshoe 1500 described above in connection with FIGS. 15-18K, there are a number of differences including a slightly different shape of the deck 102. In this regard, it will be appreciated that many deck shapes are possible including teardrop-shaped decks, oval decks, and the like. The particular shape selected can be varied depending on the intended use (walking, racing, back-country access), the size and weight of anticipated users, and the like.

FIGS. 8-14 show a snowshoe 800 constructed in accordance with a still further aspect of the present invention, the illustrated snowshoe 800 may be of similar construction to the snowshoes described above including a multilayer, multi-density foam construction for the deck 802. However, the illustrated snowshoe 800 is different in a number of respects. For example, the illustrated snowshoe 800 includes a number of smaller traction plates 806 in place of a single larger traction plate. In addition, the illustrated deck 802 includes a number of peripheral lugs 808 but no additional internal traction protrusions.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A snowshoe comprising:

a deck for providing floatation in snow, said deck having a front portion adjacent a front end of said deck, a back portion adjacent a back end of said deck, and a middle portion between said front portion and said back portion; and a binding for attaching the deck to a user's footwear;

wherein said deck has a multi-density foam construction including a first layer having a first density and a second layer having a second density different than said first density, and said deck has thickness that is greater in said middle portion than in said front and back portions, said deck having a bottom surface that is continuously curved from said front end to said back end, said bottom surface having a first nonzero curvature at said front portion, a second nonzero curvature at said back portion, and a third nonzero curvature at said middle portion, wherein the third curvature is less than the first and second curvatures.

2. A snowshoe as set forth in claim 1, wherein said deck has an upper surface and a lower surface, said upper surface being adjacent to said binding and said lower surface being a primary snow-contact surface, wherein said first layer is disposed lower in said deck than said second layer and has a higher density than second layer.

3. A snowshoe as set forth in claim 1, wherein said first layer is a lower layer and has a hardness of between about 50-65 Aster C durometer.

4. A snowshoe as set forth in claim 1, wherein said second layer is an upper layer and has a hardness of between about 35-45 Aster C durometer.

5. A snowshoe as set forth in claim 2, wherein said deck further comprises a third layer, disposed at least partially between said first layer and said second layer, having a third density different than said first density and said second density.

6. A snowshoe as set forth in claim 1, wherein said deck has an upper surface adjacent to said binding, a lower surface opposite said user surface, a front end and a rear end, wherein said front end is a leading end of said snowshoe during use, and said lower surface has a continuously curved shape from said rear end to said front end so as to promote a rocking motion in use from rear end stepping plant to front end stepping push-off.

7. A snowshoe as set forth in claim 1, wherein said deck has a varying bottom-to-top thickness relative to a front-to-back axis of said deck.

8. A snowshoe as set forth in claim 7, wherein said deck has a first thickness adjacent a front end of said snowshoe, a second thickness adjacent a back end of said snowshoe, and a third thickness.

9. A snowshoe as set forth in claim 1, wherein said deck is configured as a continuous web of material substantially free from any openings therethrough.

10. A snowshoe as set forth in claim 1, further comprising at least traction element disposed on a bottom surface thereof.

11. A snowshoe as set forth in claim 10, wherein said traction element is formed from a material different from said first and second layers.

12. A snowshoe as set forth in claim 10, wherein said traction element is formed from plastic.

13. A snowshoe comprising:

a deck for providing floatation in snow, said deck having a front end and a back end; and a binding for attaching the deck to a user's footwear such that the binding is maintained in a substantially fixed position in relation to the deck during use free from pivoting motion between the binding and deck;

wherein said deck has a multi-density foam construction including a first layer having a first density and a second layer having a second density different than said first density, said deck having a bottom surface that is continuously curved from said front end to said back end, said bottom surface having a first nonzero curvature at a first portion thereof adjacent said front end, a second nonzero curvature at a second portion thereof adjacent said back end, and a third nonzero curvature at a third portion thereof between the first and second portions, wherein the third curvature is less than the first and second curvatures.

14. A snowshoe as set forth in claim 13, wherein said deck has a continuously curved shape from a rear end to a front end of said deck.

15. A snowshoe as set forth in claim 13, wherein said deck has a greater thickness at a center portion thereof and tapered thickness at front and back end portions thereof to allow for flexing in connection with said stepping motion.

16. A snowshoe comprising:

a deck for providing floatation in snow, said deck having a multi-density foam construction including a first layer having a first density and a second layer having a second density different than said first density; and a binding for attaching the deck to a user's footwear;

wherein said deck has a number of cleats on a bottom surface thereof, said cleats being distributed from side-to-side and from front-to-back across substantially the entirety of said bottom surface, each said cleat including at least three spikes arranged in a nonlinear configuration, wherein said deck includes a number of lugs extending from a bottom surface thereof, said lugs being distributed about a periphery of said deck.

* * * * *